United States Patent [19]

McCleerey

[11] 4,436,361

[45] Mar. 13, 1984

[54] HERMAPHRODITIC BACK SHELL COVER

[75] Inventor: Earl W. McCleerey, Mechanicsburg, Pa.

[73] Assignee: AMP Incorporated, Harrisburg, Pa.

[21] Appl. No.: 323,207

[22] Filed: Nov. 20, 1981

[51] Int. Cl.³ ..... H01R 4/24

[52] U.S. Cl. ..... 339/97 P; 339/206 R

[58] Field of Search ..... 339/97 P, 98, 99 R, 339/103 M, 107, 206 R

[56] References Cited

U.S. PATENT DOCUMENTS

| | | | |
|---|---|---|---|
| 3,101,229 | 8/1963 | Yopp | 339/59 |
| 3,467,942 | 9/1969 | Dell et al. | 339/91 R |
| 3,821,691 | 6/1974 | Reimer | 339/206 R |
| 4,080,041 | 3/1978 | Hawkins, Jr. | 339/196 M |
| 4,108,527 | 8/1978 | Douty et al. | 339/107 |
| 4,243,288 | 1/1981 | Lucius et al. | 339/206 R |
| 4,327,956 | 5/1982 | Sitzler | 339/107 |

FOREIGN PATENT DOCUMENTS

| | | |
|---|---|---|
| 2352419 | 12/1977 | France . |
| 2042827 | 9/1980 | United Kingdom . |

*Primary Examiner*—Joseph H. McGlynn
*Assistant Examiner*—Gary F. Paumen
*Attorney, Agent, or Firm*—Russell J. Egan

[57] ABSTRACT

A hermaphroditic assembly formed by a pair of cover members is disclosed for enclosing the back portion of an electrical connector so as to protect the junction of conductors and electrical terminals carried thereby. The cover members are assembled with a known connector by moving them transversely of the connector relative to each other until mating engagement is achieved.

5 Claims, 4 Drawing Figures

HERMAPHRODITIC BACK SHELL COVER

The present invention relates to a back shell cover for an electrical connector, and in particular, to a shell formed by two hermaphroditic members which can be snap assembled to enclose the rear of a known connector. Contrary to most known covers, the present covers are moved over the connector transversely from opposite ends.

It is the common practice in the field of electrical connectors to provide some kind of rear cover to the connector to enclose and protect the juncture of the terminals carried thereby and the associated conductors terminated therein. These rear covers have generally been of two tapes, namely, a single piece housing which requires that the conductors be fed through an opening prior to termination and then the cover is slipped into place against the connector, or a two piece clam shell type arrangement enclosing the connector from the opposite elongated sides. An example of this latter type can be found in U.S. Pat. No. 4,243,288. Each of these known covers have disadvantages, particularly when it is necessary to effect a repair of a conductor or terminal in the connector.

The present invention overcomes the difficulties of the known prior art by providing a shell assembly having a pair of hermaphroditic members which slide transversely over the back of a housing from opposite ends toward the center to latchingly engage.

The present invention is designed to be used in cooperation with a known electrical connector and comprises a pair of hermaphroditic rear cover members which together define a back shell closely enclosing a rear portion of an electrical connector. The rear cover members each have a pair of spaced walls with and intermediate connecting wall, alignment means on the free ends of the spaced walls, a latching extension on one spaced wall, and a groove on the opposite spaced wall for receiving a latching extension, and means to grippingly engage the connector housing.

An embodiment of the present invention will now be described by way of example with reference to the accompanying drawings in which.

Figure 1:
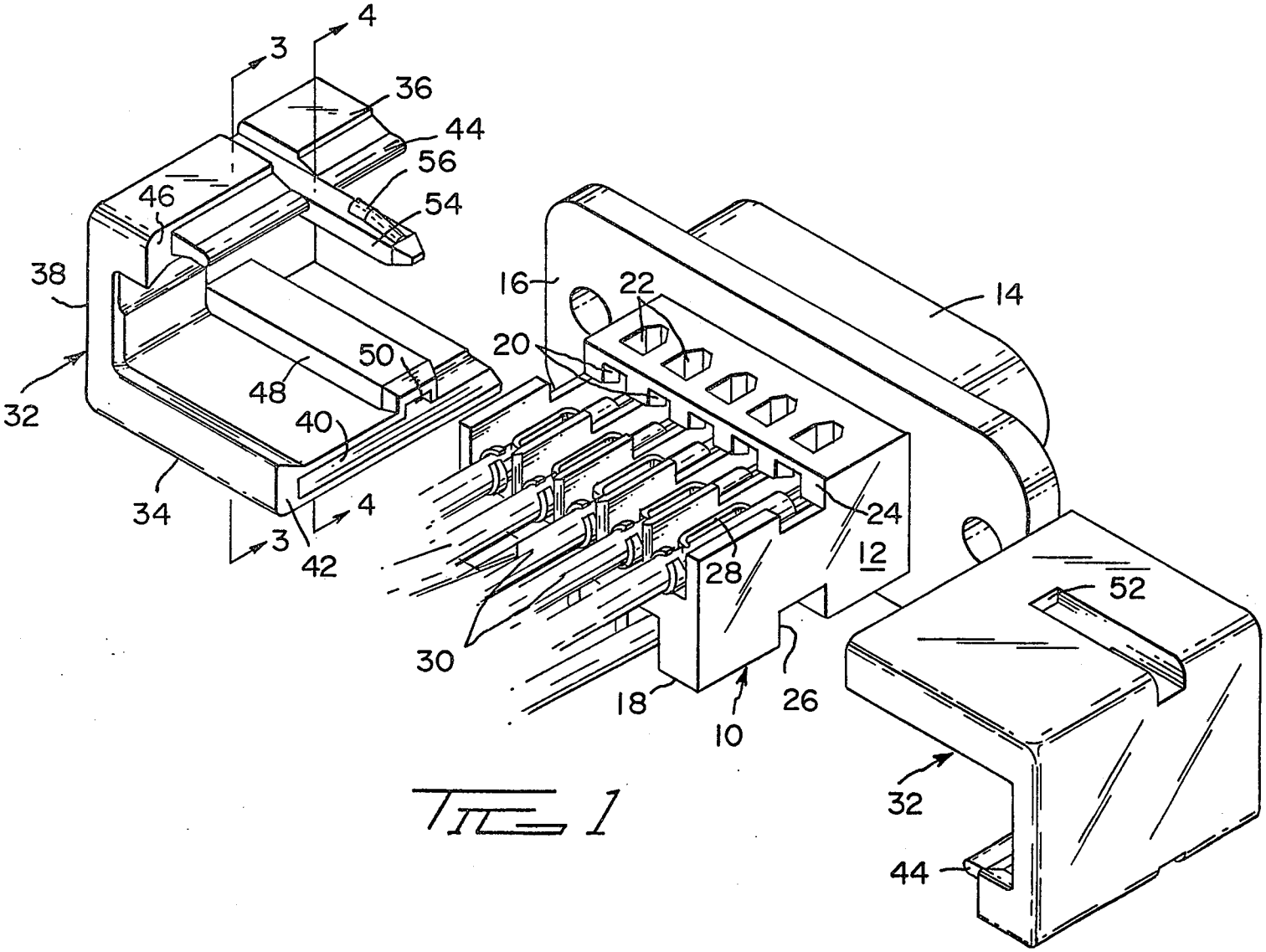
FIG. 1 is an exploded perspective view of the subject invention and a known electrical connector.

The present invention has been shown in combination with a known electrical connector 10 which can be of the type disclosed in the above mentioned U.S. Pat. No. 4,243,288, the disclosure of which is incorporated herein by reference. The connector 10 has an elongated housing 12 of rigid insulative material with a mating face 14, an intermediate integral mounting flange 16, and an open rear portion 18. A plurality of terminal passages 20 extend between the mating face 14 and rear portion 18 in a pair of aligned rows. The sides of the housing 12 are open at the rear portion 18 so that the passages 20 are enclosed at their forward ends and are channel-shaped opening outwardly at their rearward ends. The housing also includes latching apertures 22 each aligned with a respective passage 20 and spaced rearwardly of flange 16. The housing also has a pair of oppositely and outwardly directed, transversely extending recesses 24, 26.

The connector 10 also includes a plurality of terminals 28. These terminals can be similar to the terminals 18 of the above noted patent. Each has a mating end (not shown) and an oppositely directed end adapted to terminate a respective conductor 30. The conductor engaging ends preferably are of an insulation piercing type and lie in the exposed rear portion of the housing.

The present invention is comprised of a pair of hermaphroditic cover members 32, 32, made of a fairly rigid plastics material. Each cover member 32, 32 has a first long wall 34, a second parallel spaced short wall 36, and an integral intermediate wall 38 interconnecting the first and second walls. The first wall 34 has an elongated groove 40 in and extending along the free edge 42 thereof. The short wall 36 has an elongated flange 44 extending from the free edge 46 thereof. The long wall 34 has a transversely extending rib 48 which forms a channel 50 opening in the groove 40 and opening outwardly of the first wall 34 forming a shoulder or stop 52. The short wall 36 has a latching member 54 extending from the free edge 46 thereof aligned to be received in the channel 50 and having an outwardly directed lug 56 adapted to engage the shoulder 52.

Figure 2:
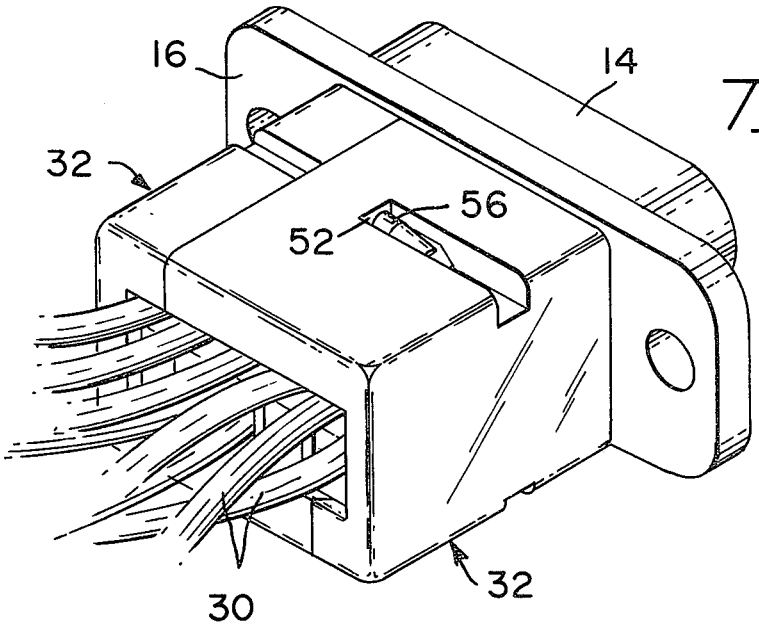
FIG. 2 is a perspective view of the subject invention assembled on the known electrical connector.
Figure 3:
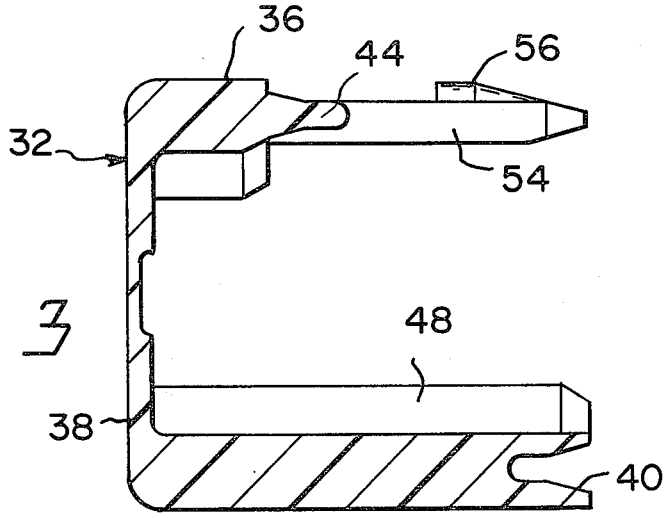
FIG. 3 is a transverse vertical section taken along line 3—3 of FIG. 1.
Figure 4:
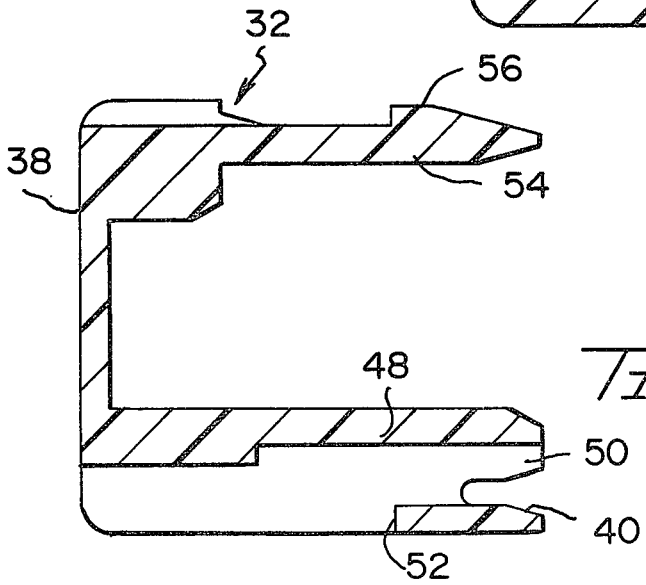
FIG. 4 is a transverse vertical section taken along line 4—4 of FIG. 1.

It will be clear from FIGS. 1 and 2 that the subject invention is mounted on the terminated connector 10 by simply bringing the mating cover members 32, 32 into cooperative engagement from opposite ends of the connector housing 12. The ribs 48 of the covers 32, 32 will engage in the respective transverse recesses 24, 26 of the housing 12 to securely hold them in place against movement perpendicular to the mating face 14. The latches 54 will extend through the channels 50 until the lugs 56 engage with the shoulders 52 to securely hold the cover members together. The flange 44 will engage in the groove 40 to further stabilize the cover members.

I claim:

1. A hermaphroditic cover which, with an identical cover, is intended to be mounted transversely on and enclose an open rear portion of an electrical connector, said hermaphroditic cover comprising:

a unitary member of molded insulative material having parallel spaced first and second sidewalls of unequal length and an intermediate wall extending normal to and joining said first and second sidewalls along one aligned marginal edge of each said first and second sidewalls, said sidewalls and said intermediate wall together defining half of a through cavity for receiving said rear portion of said electrical connector therein, and interengaging means on the free edges of said first and second sidewalls to hold said cover in aligned secured condition with a like cover, said interengaging means being formed by a groove extending substantially along the entire free edge of one of said sidewalls, and a flange extending substantially along the entire free edge of the other of said sidewalls and being receivable in a groove of a like cover.

2. A hermaphroditic cover according to claim 1 further comprising:

means for grippingly engaging said connector formed by at least one rib on at least one of said sidewalls directed inwardly toward the other sidewall and extending normal to said intermediate wall, said rib engaging in a transverse groove in said connector.

3. A hermaphroditic cover according to claim 1 further comprising:

means for securing said hermaphroditic cover to an identical cover formed by a latching member extending normally from a free edge of one of said sidewalls, said latching member having a latching lug thereon, and a latching channel extending normally into the other of said sidewalls from a free edge, said channel having a latching shoulder, whereby a latching member of one cover is received in a channel of an oppositely oriented identical cover with said latching lug engaging said latching shoulder.

4. In combination with an elongated electrical connector designed to terminate a plurality of electrical conductors, a back shell assembly enclosing and protecting the termination of said conductors in said connector and comprising:

a pair of hermaphroditic cover members together defining a through cavity for receiving a portion of said connector therein, each said cover member having first and second parallel spaced walls, and an intermediate wall interconnecting respective first ends of said first and second walls, each said first wall having an elongated groove in the free end thereof, a transversely extending rib on the inner surface of said first wall defining a channel intersecting said groove and an outwardly directed shoulder spaced from said free end, said second wall having an elongated flange in the free edge thereof adapted to be received in the groove of said first wall of the other cover member, and latching means having an outwardly directed lug, whereby a pair of oppositely oriented cover members are brought together transversely of the connector and snap fitted together with said second wall flange engaging in said first wall groove and said latching means extending through said channel with said lug engaging said shoulder to enclose the rear terminating portion of said electrical connector.

5. A back shell assembly for enclosing an open rear portion of an elongated electrical connector designed to terminate a plurality of electrical conductors in said open rear portion and having at least one transverse channel extending across said connector at a location spaced from a mating face of said connector, said back shell assembly enclosing and protecting the termination of said conductors and comprising:

a pair of hermaphroditic cover members together defining a through cavity for receiving a portion of said connector therein, each said cover member having a first long wall, a second parallel spaced short wall, and an intermediate wall interconnecting said first and second walls along one aligned marginal edge of each said first and second walls, said first wall having an elongated groove extending along substantially the entire free edge thereof and said second short wall having an elongated flange extending along substantially the entire free edge thereof adapted to be received in the groove of said long wall of another cover member, a transversely extending rib on an inner surface of said long wall forming a channel intersecting said groove and opening outwardly to define a shoulder, latching means on said short wall including an outwardly directed lug, said latching means adapted to extend through said channel with said lug engaging said shoulder, whereby, a pair of oppositely oriented cover members are snap fitted together to enclose a rear terminating portion of an electrical connector.

* * * * *